US006622859B2

(12) United States Patent
Morgenstern

(10) Patent No.: US 6,622,859 B2
(45) Date of Patent: Sep. 23, 2003

(54) GOLF BAG

(76) Inventor: Jürgen Morgenstern, In der Rehwiese 11, 40629 Dusseldorf (DE)

( * ) Notice: Subject to any disclaimer, the term of this patent is extended or adjusted under 35 U.S.C. 154(b) by 0 days.

(21) Appl. No.: 10/132,648

(22) Filed: Apr. 25, 2002

(65) Prior Publication Data

US 2002/0162761 A1 Nov. 7, 2002

Related U.S. Application Data

(63) Continuation of application No. PCT/DE00/03768, filed on Oct. 25, 2000.

(30) Foreign Application Priority Data

Oct. 26, 1999 (DE) ..... 199 51 465

(51) Int. Cl.[7] ..... A63B 55/00; A63B 55/04; A63B 55/06

(52) U.S. Cl. ..... 206/315.3; 206/315.6; 280/DIG. 6

(58) Field of Search ..... 206/315.2, 315.6, 206/315.3; 280/DIG. 6; 211/70.2

(56) References Cited

U.S. PATENT DOCUMENTS

| | | | | | |
|---|---|---|---|---|---|
| 1,637,538 | A | * | 8/1927 | Sampson | 206/315.3 |
| 2,890,061 | A | * | 6/1959 | Watson | 280/DIG. 6 X |
| 3,967,667 | A | * | 7/1976 | Robinson | 206/315.2 |
| 4,245,684 | A | * | 1/1981 | Street et al. | 206/315.3 |
| 4,319,616 | A | * | 3/1982 | Light | 206/315.3 |
| 4,383,563 | A | * | 5/1983 | Kirchhoff, Jr. | 206/315.3 |
| 4,915,221 | A | * | 4/1990 | Spangler | 206/315.6 |
| 5,029,703 | A | | 7/1991 | Dulyea, Sr. | |
| 5,168,992 | A | * | 12/1992 | Bowdy | 206/315.6 |
| 5,730,285 | A | * | 3/1998 | Sheehan | 206/315.3 |
| 6,044,880 | A | * | 4/2000 | Maeng | 206/315.2 X |
| 6,145,660 | A | * | 11/2000 | Chou | 206/315.3 |

FOREIGN PATENT DOCUMENTS

| | | | | |
|---|---|---|---|---|
| AU | 216273 | * | 10/1995 | 206/315.3 |
| GB | 2134797 | * | 8/1984 | 206/315.3 |
| WO | 9205842 | * | 4/1992 | 206/315.3 |
| WO | 9411065 | * | 5/1994 | 206/315.3 |

* cited by examiner

*Primary Examiner*—Sue A. Weaver
(74) *Attorney, Agent, or Firm*—Akerman Senterfitt

(57) ABSTRACT

A golf bag for receiving a plurality of golf clubs. The bag comprises a bag body (1) with a longitudinal axis (13), an inner chamber (11) and a lateral area (12) which essentially extends in the direction of the longitudinal axis (13). Holding devices (2) are arranged on or within the lateral area (12). The holding devices are used for receiving golf clubs (3) having club shafts (32) that essentially extend in the direction of the longitudinal axis (13). Golf clubs held in holding devices (2) are situated outside the inner chamber (11). A golf club (3) that is held in a holding device (2) is essentially covered on the side facing away from the inner chamber (11) by a self-closing cover (4). The bag body (1) is composed of two shells (16) and can be unfolded along a hinge axis (7) which extends essentially in parallel in relation to the longitudinal axis (13) thereof, whereby the inner chamber (11) thereof becomes accessible.

15 Claims, 11 Drawing Sheets

GOLF BAG

CROSS-REFERENCE TO RELATED APPLICATION

This is a continuation of PCT/DE00/03768 filed Oct. 25, 2000.

The present invention relates to a golf bag for containing a plurality of golf clubs according to the preamble of the main claim.

BACKGROUND OF THE INVENTION

Several problematic aspects occur with today's golf bags. The clubs contained in the golf bag cannot be secured within the golf bag without additional measures. This makes it troublesome for a player to select a desired club from the many clubs contained in the bag. Due to the loose containment of the golf clubs in a conventional golf bag, the missing of a golf club is generally noticed too late or not at all.

U.S. Pat. No. 5,029,703 describes an insert for a golf bag which is mountable within a golf bag in proximity to the open top thereof. A base portion may additionally be provided, said base portion being inserted in the bottom of the golf bag. The insert, which is arranged in the upper part, is provided with clips that may retain the club shafts. The base portion is provided with recesses which define seats for the club grips of the golf clubs carried in the bag. Additional inserts may be provided for longitudinally dividing the interior of the golf bag in various compartments, which may be used for separating the golf club woods, irons and the putter. This arrangement enables the player to organize orderly the golf clubs in a golf bag. This however does not solve the problem that there is no rain protection provided.

It is therefore the object of the present invention to indicate a golf bag that allows the golf clubs to always be retained in an orderly fashion and to be extracted easily and without difficulty, that allows for increased weather resistance without loss of operating convenience and that has a holding capacity that is at least comparable to that of conventional golf bags while at the same time allowing for a better use thereof.

BRIEF SUMMARY OF THE INVENTION

The solution of this object is achieved by a golf bag provided with the features of claim 1.

The golf clubs retained in the holding devices are thereby substantially located outside the interior space of the golf bag. Furthermore, self-closing covers are provided for largely covering the golf clubs retained in holding devices on the side which is turned away from the interior space of the bag. Such a self-closing cover may be configured in such a manner that it covers one or several golf clubs retained in holding devices. More specifically, such type self-closing covers permit to cover all of the holding devices arranged on or within the lateral area together with the golf clubs which are possibly retained therein. This is not absolutely necessary though, some holding devices may be realized without cover for retaining often used clubs, such as a putter. The holding devices are configured as clips, fixations, lead-in shoes or the like.

The bag body is given the required shape stability in that the lateral area is provided with an inherent rigidity in a manner similar to that of conventional golf bags. In support thereof, both the cover and the bottom surfaces may also be provided with an inherent rigidity. Alternatively, the bag body may be equipped with a rigidity providing frame which is preferably arranged in the interior of the bag body. A cloth covering having but little inherent rigidity and constituting both the lateral area and the cover and bottom surfaces may be stretched on said frame.

It proved particularly advantageous to provide the lateral area of the bag body with recesses that are oriented substantially in the direction of the longitudinal axis of the bag body. Each of said recesses may be largely, more specifically completely, covered with a self-closing cover. Holding devices for holding at least one club each are arranged in the recesses. Particular advantages derive from a realization of the recesses that permits the clubs retained in the holding devices to be encompassed by the recesses in the direction of the longitudinal axis of the bag body. That is to say that the retained clubs are almost completely embedded in the recesses of the lateral area. More specifically, the realization may be such that the golf bag according to the invention may rest on the lateral area without mechanically loading the golf clubs retained in the recesses. The recesses preferably extend over a substantial portion of the width of the lateral area in the direction of the longitudinal axis of the bag body. Then, the remaining apertures of the recesses are largely covered by self-closing covers. Said covers are preferably configured to protect the clubs from weather, more specifically by making them at least splash-proof.

To further enhance the weather resistance and the transportability of a golf bag in accordance with the present invention, the self-closing covers may be locked by means of weather-proof coatings. Such a coating may be realized in the form of a textile strip with a weatherproof coating which covers a self-closing cover and may be reversibly locked by a zipper fitting. In its closed condition, said coating covers the self-closing cover, and more specifically a sealing lip which may be provided in said cover. This enhances the tightness of the cover on the one hand, on the other hand a golf club, which by chance came out of its holding device, is prevented from falling through the self-closing cover. This represents a decisive advantage in transporting the golf bag.

Advantages in removing the golf clubs from their respective holding devices are realized when the self-closing covers leave an area of a retained club uncovered, said area being dimensioned to facilitate the golfer's grasp of the club in this area and its removal from the holding device. More specifically, this may be achieved in that the covers leave the clubs uncovered on a length of less than 15 cm, preferably of less than 10 cm, but of more than 5 cm. A grip area or recessed grip cavity, which may more specifically be arranged in proximity to the respective one of the club heads or club grips, is thus obtained.

A holding device retains a club to be fixed on at least one point, preferably on two points though. A holding device is thereby preferably provided with at least one clip for positively fixing a club shaft or a club grip.

Additionally or alternatively, the holding device may be provided with at least one fixation for positively fixing a club head, and more specifically the club faces. Said fixation may also be adapted to the different types of clubs such as woods, irons, putter or individual clubs.

Such a fixation is preferably provided in the area of the cover surface of the bag body for the purpose of receiving the heads of individual clubs. The heads may be suspended in such a fixation so that the corresponding clubs may readily be identified by their head and taken out of their holding devices. In order to enhance user-friendliness, a recessed grip cavity is formed in the fixation. Such a fixation may for example be inserted as a cover surface in an open topped bag body as it is known with conventional golf bags. Such a fixation preferably receives the inward directed heads of retained golf clubs.

Particular advantages with regard to the distribution of load alongside the golf bag in accordance with the invention are realized when neighboring holding devices are designed to hold a club in an upright position in a first holding device while the clubs in the neighboring second holding devices may be held with their head down. This alternating arrangement of the clubs in their holding devices allows for even distribution of load alongside the golf bag and may be particularly advantageous for transporting the bag by car or airplane. It is possible to arrange all of the clubs with their head down or all of the clubs with their head up.

In practical use on the golf course, it may be advantageous to have the retained clubs arranged in another way on the lateral area of the inventive golf bag. An arrangement in which all of the retained clubs are held with the golf club head down more particularly results in a particularly low center of gravity, which may have some advantages for transporting a golf bag in accordance with the present invention on a caddy/trolley. The possibility of varying the arrangement of the clubs between an alternating arrangement and an arrangement with all the clubs held in the same position depending on the purpose they are intended to serve is therefore advantageous.

Generally speaking, a golf bag in accordance with the invention may be realized in a symmetrical design in such a manner that the top portion and the bottom portion of the golf bag are substantially identical. This conformity may relate to the shape of the bag body on the one hand and to the configuration of possible covers for the cover and bottom surfaces on the other hand.

Since the golf clubs have very different lengths ranging from 0.9 to 1.2 m, it may be advantageous to choose for the bag body a shape that provides on at least one location a club holding device provided with the length required for every length of the clubs carried in the bag. Such a bag body may for example be cylindrical in shape, i.e., have a round cross-section. To realize the length distribution described, the cover surface may be positioned at an angle different than 90 degrees to the longitudinal axis of the cylindrical body. The shape of the bag body thus obtained reminds of a truncated column. This length adjustment may be provided both in the region of the cover surface and in the region of the bottom surface.

In order to improve the transportability of a golf bag according to the invention, apertures opening downward and/or upward may furthermore be provided in the covers, through which the club grips may preferably be passed through so that they may be accessed freely. As a result thereof, the dimensions of a golf bag according to the invention, its length in particular, may be reduced so that the bag may be readily placed in the trunk of a smaller car.

To avoid excess loading of the hinges when opening such a golf bag in accordance with the invention, a stop may be provided for limiting the maximum aperture angle of the hinge and for possibly taking forces of a higher magnitude. A dampener may also be provided.

To increase the usefulness of the golf bag for carrying a plurality of single parts, the interior of the bag body may be divided into several compartments which may more specifically be realized according to a corresponding pattern. More specifically, one half of the interior space may be usable in full length for hanging a jacket or pants, preferably unfolded.

The bag body must not be partitioned in two halves of identical size, an asymmetrical division is also possible and may make sense. In particular cases, it may be appropriate to have the golf bag divided in more than only two compartments.

The golf bag in accordance with the present invention allows for accommodating the golf club taken on the golf course in a fixed arrangement. Thus, the golf clubs cannot come out of order during transporting of the golf bag. In arranging the holding devices for the golf clubs on or within the lateral area of the bag body, the holding devices may in principle be designed in such a manner that a retained golf club needs not be extracted from the golf bag along the full length thereof but may be readily removed from the side. This considerably enhances user convenience. Furthermore, the interior of the bag body remains largely or entirely usable for keeping items. As the golf clubs retained on the lateral area of the bag body are covered by self-closing covers, said retained golf clubs may be perfectly protected from the weather in designing the covers accordingly. In designing the lateral area or the recesses provided on said lateral area and receiving the golf clubs to be retained accordingly, said golf clubs may furthermore be perfectly mechanically protected. More specifically, in shaping the recesses accordingly, the retained clubs may be substantially entirely embedded in the lateral area so that the mechanical load on the retained golf clubs is minimal when the lateral area of the golf bag in accordance with the invention strikes a surface or comes to rest thereon.

Further characteristics and advantages of the golf bag according to the invention will become apparent in the following description of exemplary embodiments that are not limiting the scope of the invention and are explained in more detail with reference to the drawing.

DETAILED DESCRIPTION OF THE INVENTION

Figure 1:
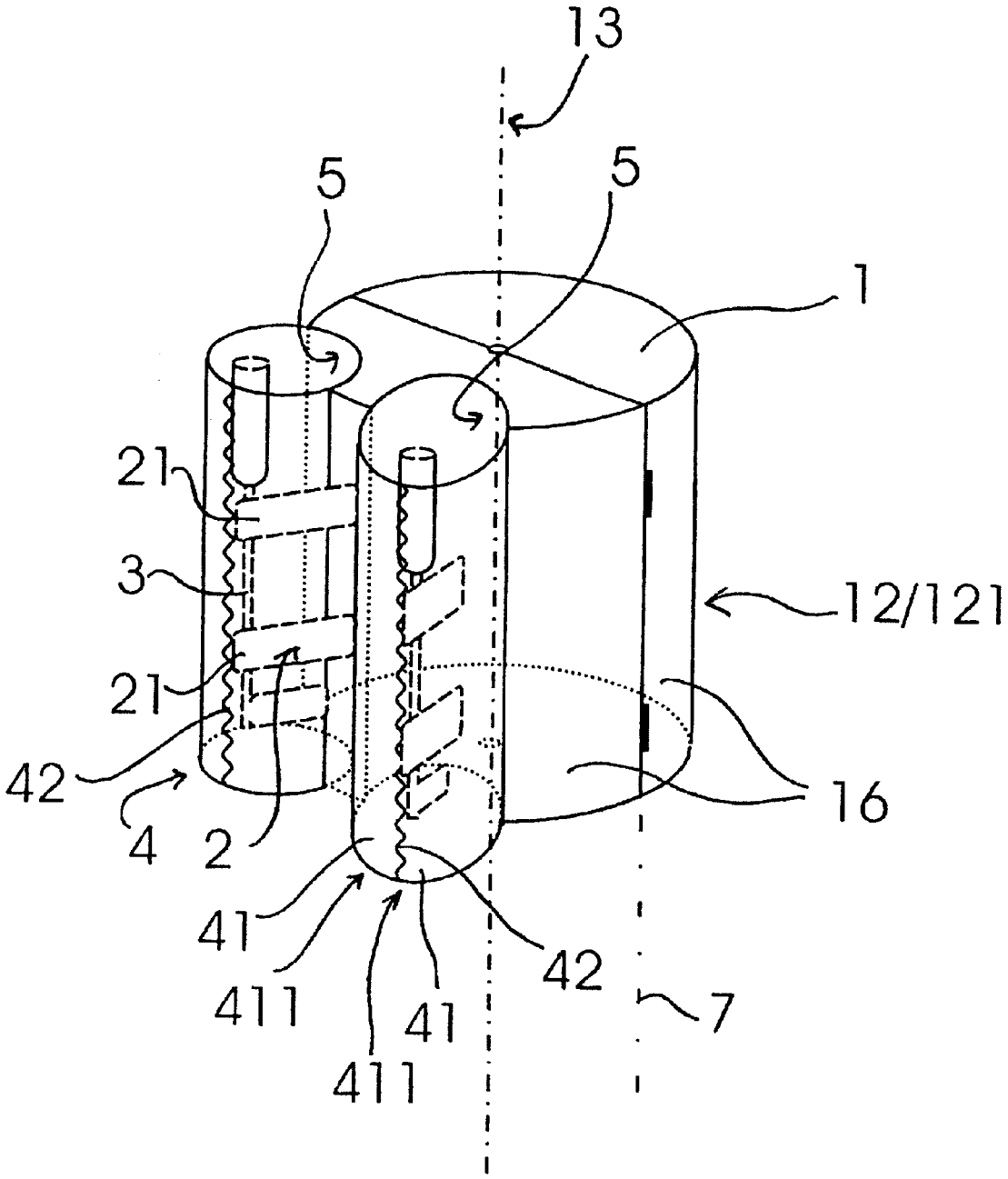
FIG. 1 is a schematic view of a first embodiment of a golf bag in accordance with the invention.

A first possible realization of a golf bag according to the invention can be surveyed from FIG. 1. The bag body 1 of the golf bag consists of a cylindrical hollow body with a longitudinal axis 13. Recesses 5 extending substantially parallel to the longitudinal axis 13 are inserted into the lateral area 12 thereof. Holding devices 2 for golf clubs 3 are arranged in these recesses 5, the golf clubs 3 being retained therein in such a manner that their shaft 32 is oriented substantially parallel to the longitudinal axis 13 of the bag body 1, said longitudinal axis representing here an axis of symmetry as well. The holding devices 2 are each formed by two clips 21 for positively retaining the shaft 32 of a golf club 3. The lower clip 21 may also be replaced by a fixation 22 for retaining the head 33 of a golf club to be retained, said fixation positively fixing the club head 33. This is not shown in FIG. 1, though.

For purposes of clarity, FIG. 1 only illustrates holding devices 2 for two golf clubs 3. In practical utilization however, a plurality of holding devices 2 for golf clubs 3 may be placed at regular or irregular intervals around the entire exterior circumference 121 of the lateral area 12 of bag body 1 or on parts thereof. More specifically, a golf bag in accordance with the invention is fitted with such a number of holding devices 2 for golf clubs 3 that the maximum permissible number of golf clubs can be carried (14 for the time being).

The shaft 32 and the grip area 33 of the retained clubs 3 are covered by a self-closing cover 4. Said cover 4 may be made of a flexible, elastic plastic material for example. In the example shown, such a cover 4 consists of two halves that are meshing or lying on top of each other so as to be at least splash-proof. The two halves 41 consist of segments of tube sections each. The desired flexible and elastic properties are achieved in using segments of rubber hoses for example. It is particularly advantageous to use transparent or translucent materials. In shaping the halves 41 accordingly, more specifically in arranging the end areas 411 of the segments in such a manner that they adjoin or lie on top of one another, a sealing lip 42 can be formed through which a retained club 3 may be readily removed. In FIG. 1, said sealing lip 42 of the two halves 41 is outlined by a wavy line. By virtue of the flexibility and the elastic properties of the covering material, the two halves 41 return to their original position once the club has been removed, the desired sealing being achieved alongside the tangent line of the two halves 41 thanks to an appropriate configuration of the sealing lip 42.

Alternatively, the covers shown in FIG. 1 may be realized in such a manner that such a cover 4 may cover one recess 5 only, or several. It is also possible to hold more than only one golf club 3 in one recess 5.

In the embodiment shown, all of the club heads 33 are directed toward the longitudinal axis 13 of the bag body in order to keep the outer circumference of the golf bag according to the invention small. For the purpose of increasing the interior space 11 of the bag, it may make sense to direct the club heads 33 outward, away from the longitudinal axis 13.

In another embodiment which is not explicitly shown, the club heads 33 are inserted into fixations 22 specially formed on or in the lateral area 12 of the bag body 1. Said fixations 22 may be configured each in such a manner that they positively receive the heads 33 of clubs 3 to be retained. This may be achieved in coating corresponding hollow spaces with special foams such as polyurethane foams for example and in subsequently molding the respective one of the club heads 33 in this foam. If such a fixation 22 for a club head 33 is being used, at least one clip 21 holding the club shaft 32 may be dispensed with.

Figure 2:
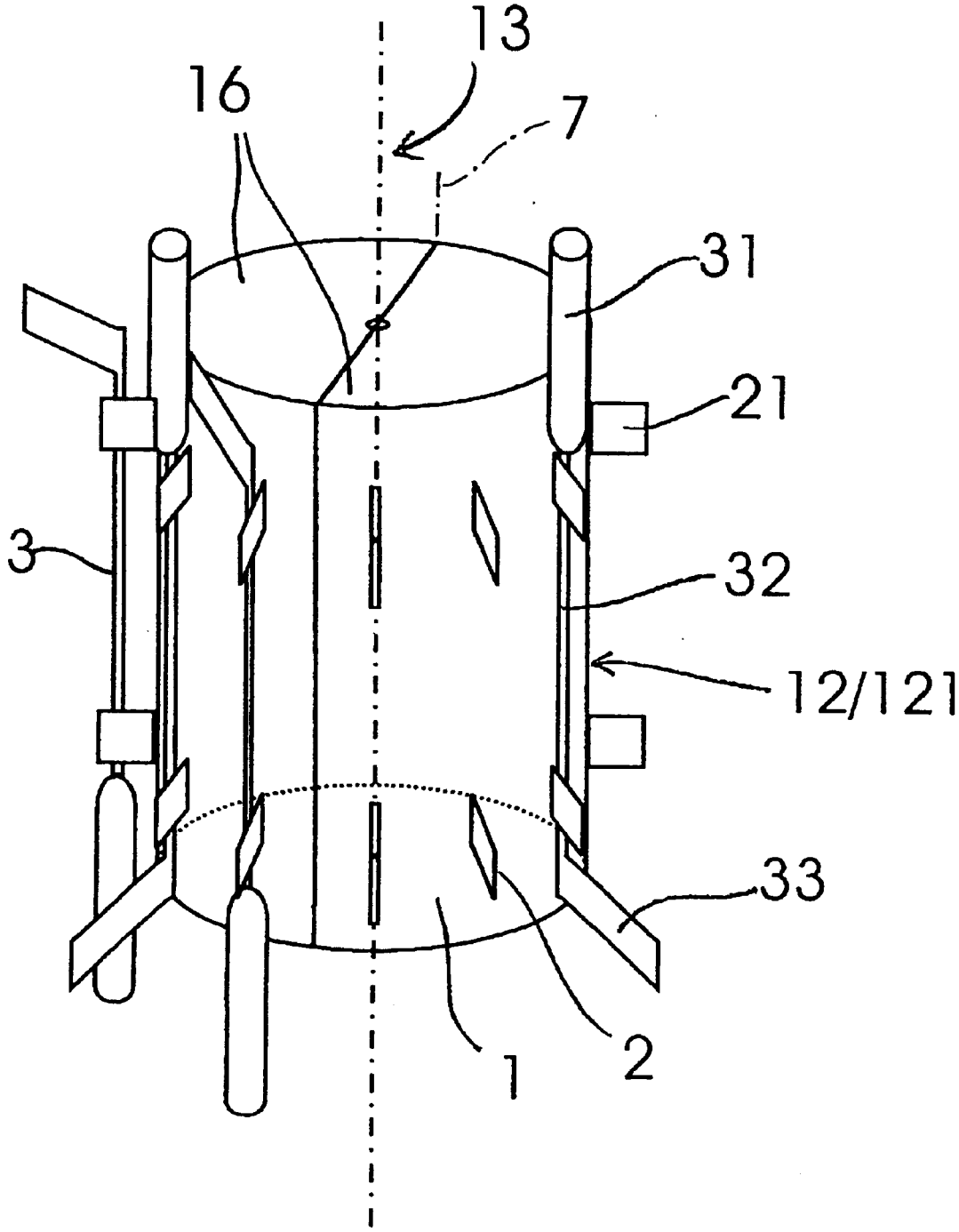
FIG. 2 is a perspective view of another embodiment of a golf bag in accordance with the invention with alternating arrangement of the retained golf clubs.

A modification of the bag body 1 of a golf bag in accordance with the invention as it has been disclosed in FIG. 1 is illustrated schematically in FIG. 2, the lateral area 12 of said bag body 1 having no recesses 5. Holding devices 2 for golf clubs 3 to be retained are placed at regular intervals on the outer circumference 121 of the lateral area 12 of the bag body 1. FIG. 2 does not show the covers 4 provided in accordance with the present invention. They may be realized in a way analogous to that of the covers in the embodiment of FIG. 1 for example.

It might be advantageous not to hold all the golf clubs 53 on the lateral area 12 with their heads 33 down. In thus arranging the golf clubs 3, the center of gravity is very low, which may be advantageous for transporting a golf bag according to the invention on the golf course by means of a caddy/trolley, but which may prove adverse in transporting the inventive golf bag with golf clubs 3 retained therein by car or airplane for example. It may therefore be advantageous if the holding devices 2 provided on the lateral area 12 permit to receive the clubs 3 both with their heads 33 down and up. More specifically, it may be advantageous to have neighboring clubs 3 alternately arranged with the golf club head down and up, as can be surveyed from FIG. 2. This provides for a particularly even distribution of load along the golf bag in accordance with the invention.

Figure 3:
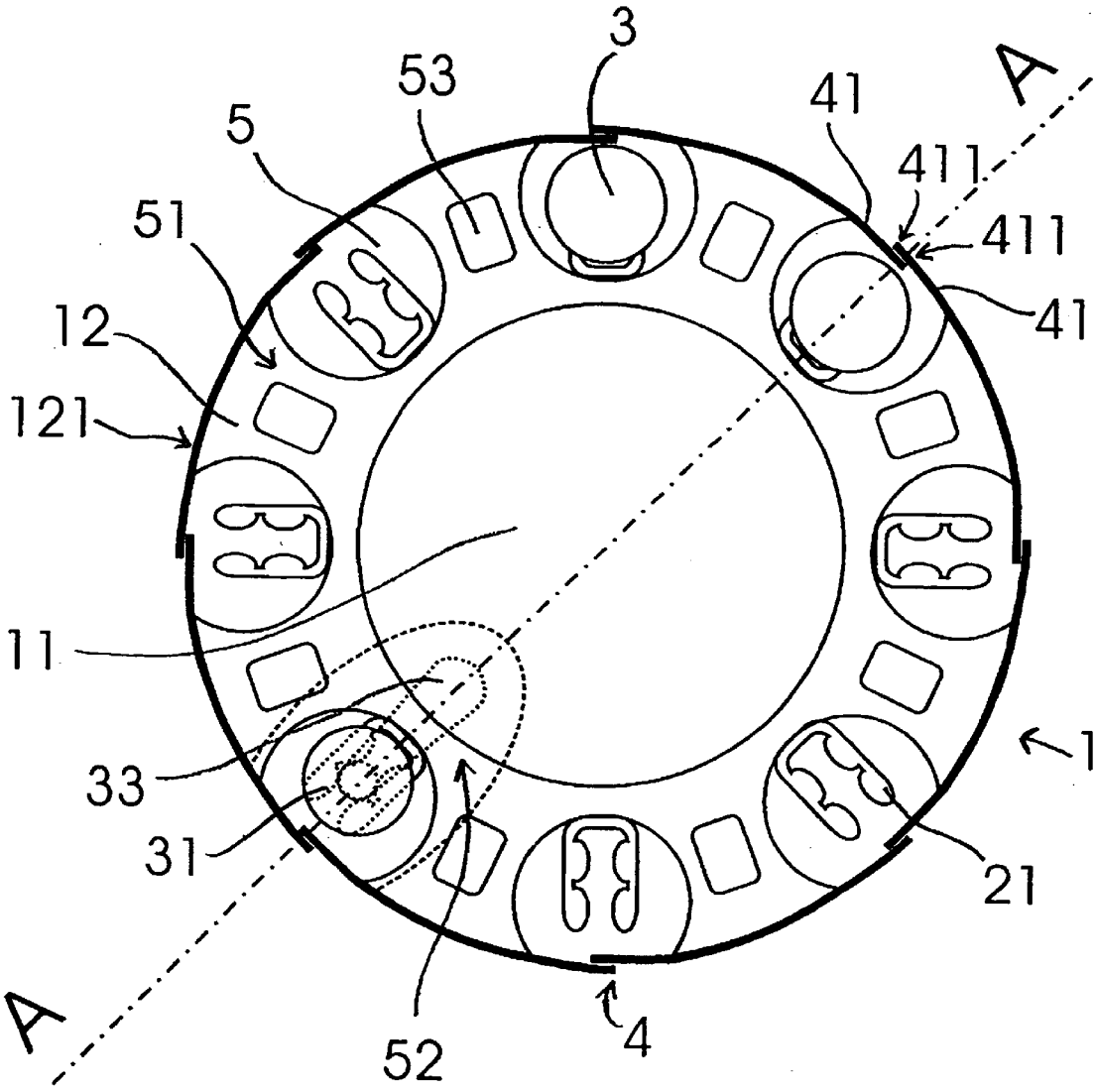
FIG. 3 is a top view of another embodiment of a golf bag in accordance with the invention in which clubs are retained in recesses provided in the lateral area, the self-closing covers also being shown.

In contrast to the embodiment shown In FIG. 1, the recesses 5 in the lateral area 12 may be configured in such a way that a club 3 held in such a recess 5 almost entirely rests within the circumferential area around the lateral area 12 of the bag body 1. A top view of such an embodiment is illustrated in FIG. 3. If the bag body 1, and more specifically the ribs 51 located between the recesses 5, are mechanically configured accordingly, the clubs 3 retained in the recesses 5 are very well protected from mechanical damage. The bag body 1 of this embodiment may be made from a plastic material such as polystyrene or ABS for example, and more particularly be of a lightweight construction that provides for a plurality of hollow chambers 53 located in the ribs 51.

The clubs 3 retained in recesses 5 in the lateral area 12 are protected from the weather by self-closing covers 4. As already described herein above, such a cover 4 may be composed of two halves 41 that may be made each from a flexible, elastic plastic material. In shaping them accordingly, the two superposed end areas 411 of the halves 41 may be biased against each other, thus forming an at least splash-proof sealing lip 42.

For removing a golf club 3, the shaft 32 thereof may be very easily removed along the tangent line/sealing lip 42 of the two halves 41, which is represented by a wavy line. To reinsert the golf club 3 into the holding device 2, the operation is reversed, the sealing lip 42 preferably closing automatically again.

Figure 4:
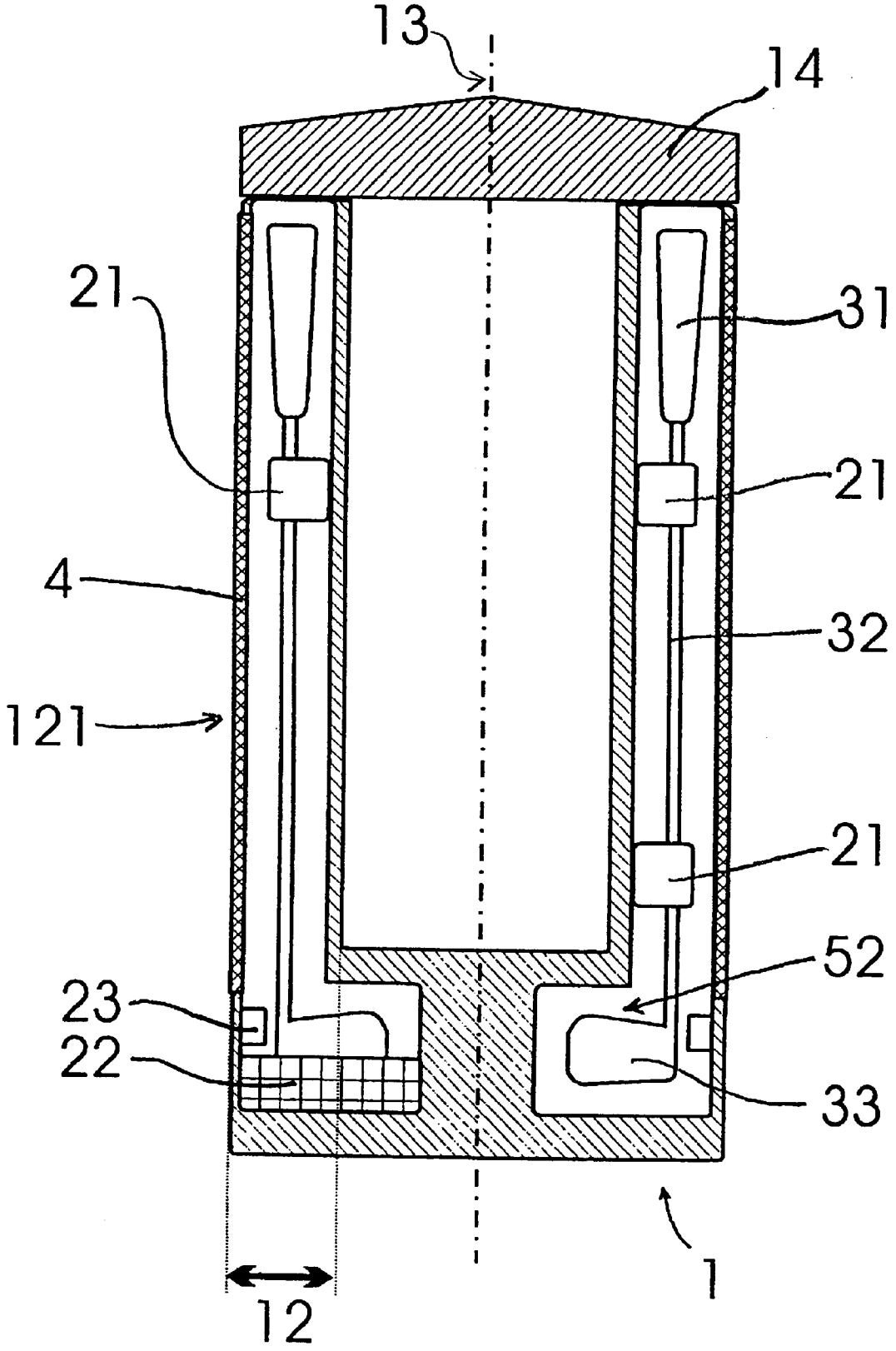
FIG. 4 is a sectional view taken along the line A—A of FIG. 3.

FIG. 4 is a sectional view through the golf bag presented in FIG. 3 along the line A—A. The dashed line represents the longitudinal axis 13 of the bag body 1 and again constitutes the axis of symmetry thereof. The bag body is shaped like a cup and covered on the top side with a lid 14 conforming to the shape of the bag body 1. Seen from the top, said lid 14 covers the retained clubs 3 preferably entirely.

The club shafts 32 of the retained clubs 3 are completely arranged in recesses 5 in the lateral area 12. The club heads are directed toward the interior space 11 and completely concealed in hollow spaces 52 provided in the bottom of the "cup". As a result thereof, the retained clubs are completely concealed within the circumferential area of the lateral area 12 of the bag, said circumferential area forming here more particularly the exterior circumference 121 of the lateral area 12.

It is suitable to realize a fixation 22 of the club heads 33 in the manner already described herein above i.e., in at least partially coating the hollow spaces 52 with a layer of foam. This is shown on the left side of FIG. 4 where a club 3 is held in a clip 21, said clip retaining the club shaft 32, and in a fixation 22 fixing the head 33.

To make it easier for the golfer to replace the club in the holding device 2 from which it was removed, insertion aids 23 may preferably be provided in the lower part of the recesses 5, said insertion aids serving to support a golf club 3 when it is being "clipped" into the holding device 2, more specifically into a clip 21.

Figure 5:
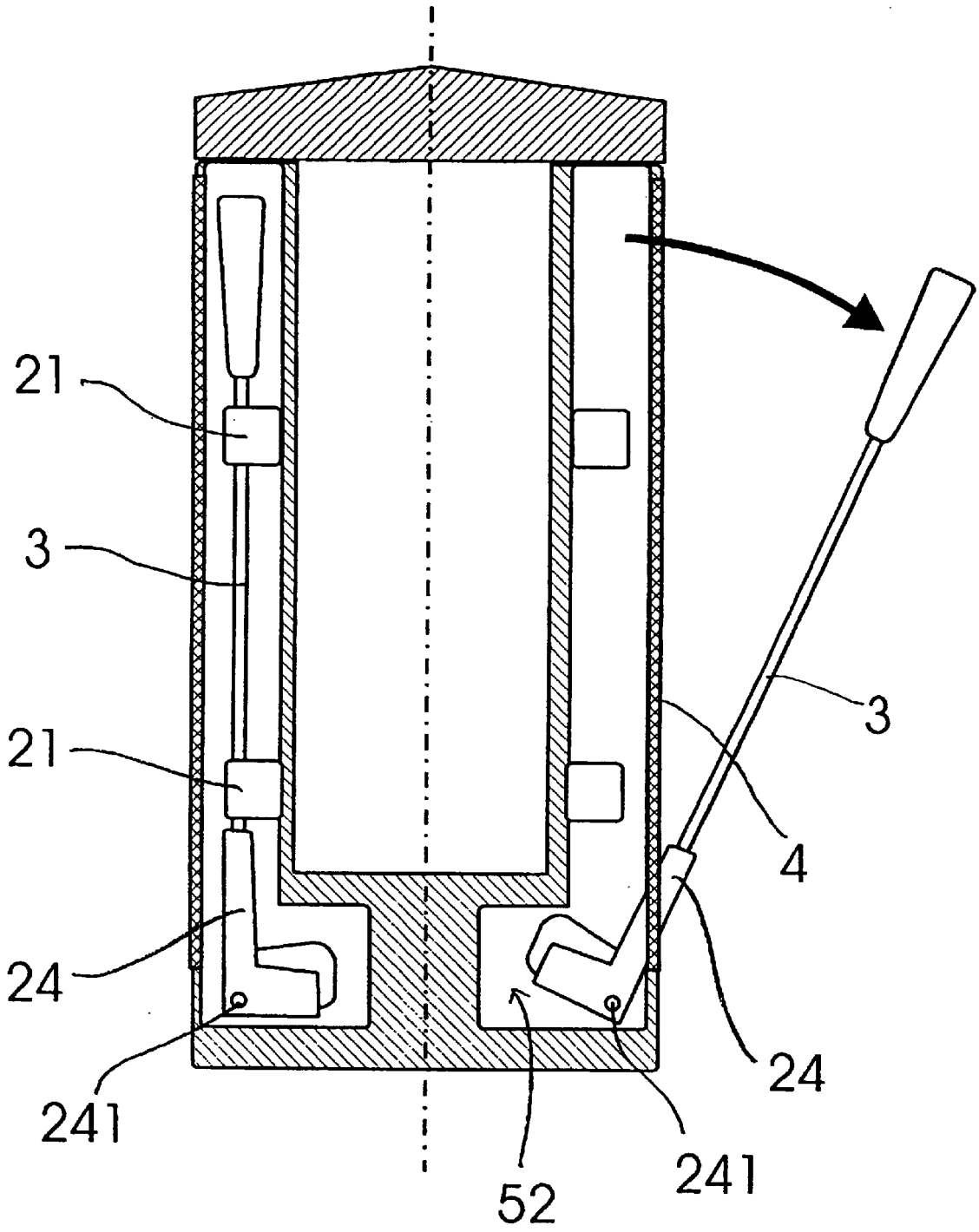
FIG. 5 is a sectional view taken along the line A—A of FIG. 3, but through another embodiment of the golf bag in accordance with the invention.

FIG. 5 illustrates a further improvement of the golf bag as shown in FIG. 4. In this embodiment, the club heads 33 are held in insertion shoes or in rocking bars 24 respectively which are preferably configured as fixations 22. The rocking bars 24 are each rotatably carried alongside an axis of rotation 241 so that they may be moved outward, as shown in FIG. 5, on the right side thereof. More specifically, they are preferably automatically moved outward when a club 3 retained therein is being removed by moving it in the direction of the arrow in FIG. 5. More specifically, the rocking bars 24 may be realized in such a manner that they are in a position of rest, without any club retained therein, when they are moved outward. This may be achieved in accordingly distributing the load of the rocking bars 24 relative to the axis of rotation 241 or by means of additional mechanical means such as springs which are capable of applying an appropriate biasing force.

This results in the major advantage that thanks to the position of the rocking bars 24, which is largely visible from the outside, the golfer can immediately notice whether individual clubs 3 have been removed from their holding devices or are altogether missing. This more specifically minimizes the risk that the golfer forgets the club 3 on the grassy surface. It also considerably enhances user convenience.

In order to avoid the drawbacks of this construction due to protruding rocking bars 24 when transporting the bag, more specifically an at least partially empty bag, a further mechanism may advantageously be provided which arrests empty rocking bars 24 in their retracted position. More specifically, swung out rocking bars 24 may be moved back by hand and then be arrested automatically or manually by the mechanism mentioned.

Figure 6:
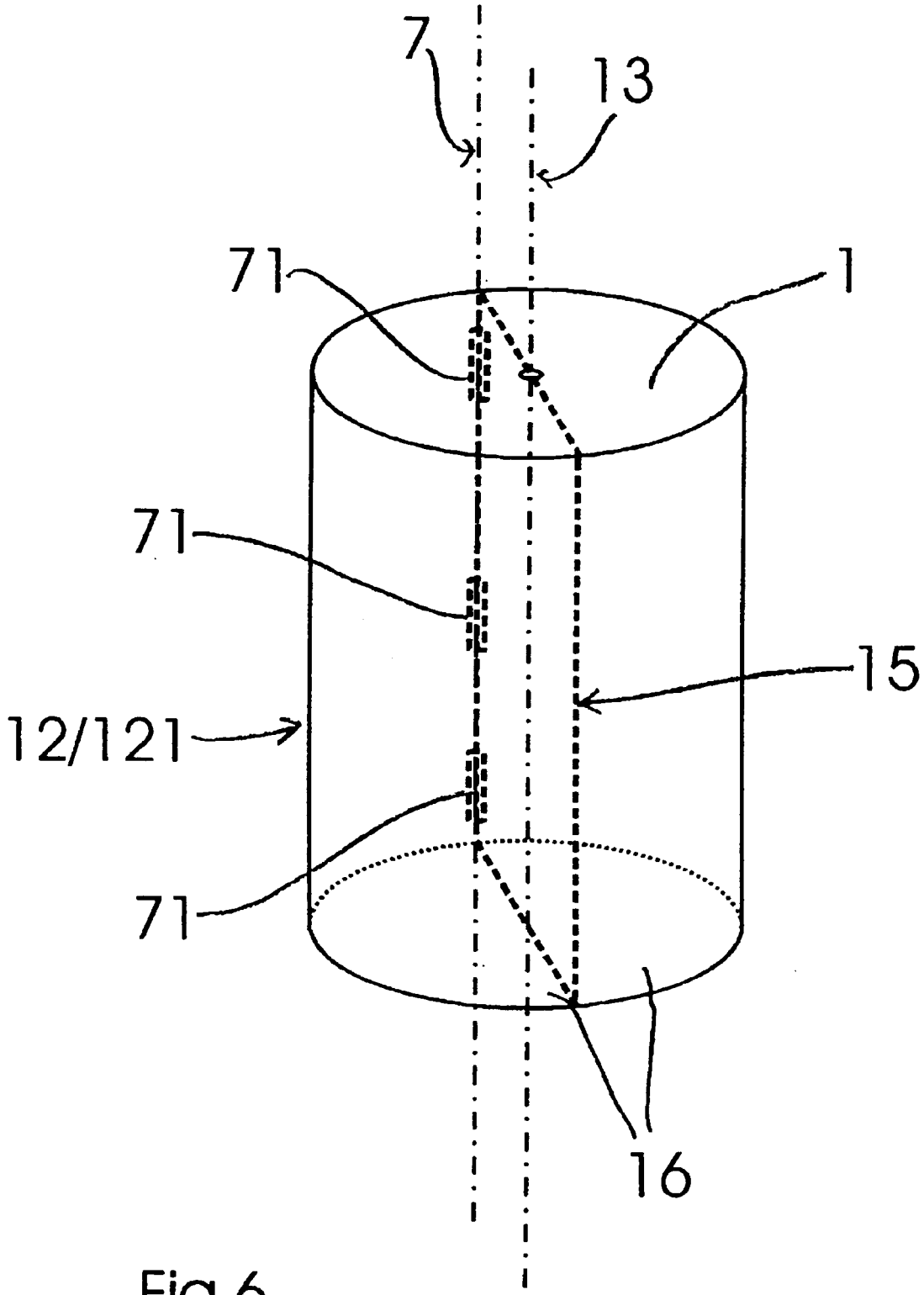
FIG. 6 is a perspective view of the bag body of a golf bag in accordance with the invention.

FIG. 6 illustrates a bag body 1 of a golf bag in accordance with the invention that consists of two shells 16 or halves that are assembled along a separating line 1. The two halves are rotatably joined together along the hinge axis 7. This is preferably achieved by means of elements that act as a joint, more particularly as a hinge. Conventional hinges may be utilized for example, but stable textile strips or anything similar may also be used. Depending on the angle of aperture intended for the bag body 1, it may make sense not to provide holding devices 2 for golf clubs 3 around the entire exterior circumference 121 of the lateral area 12 of the bag body 1, but to keep the area about the hinges free.

Figure 7:
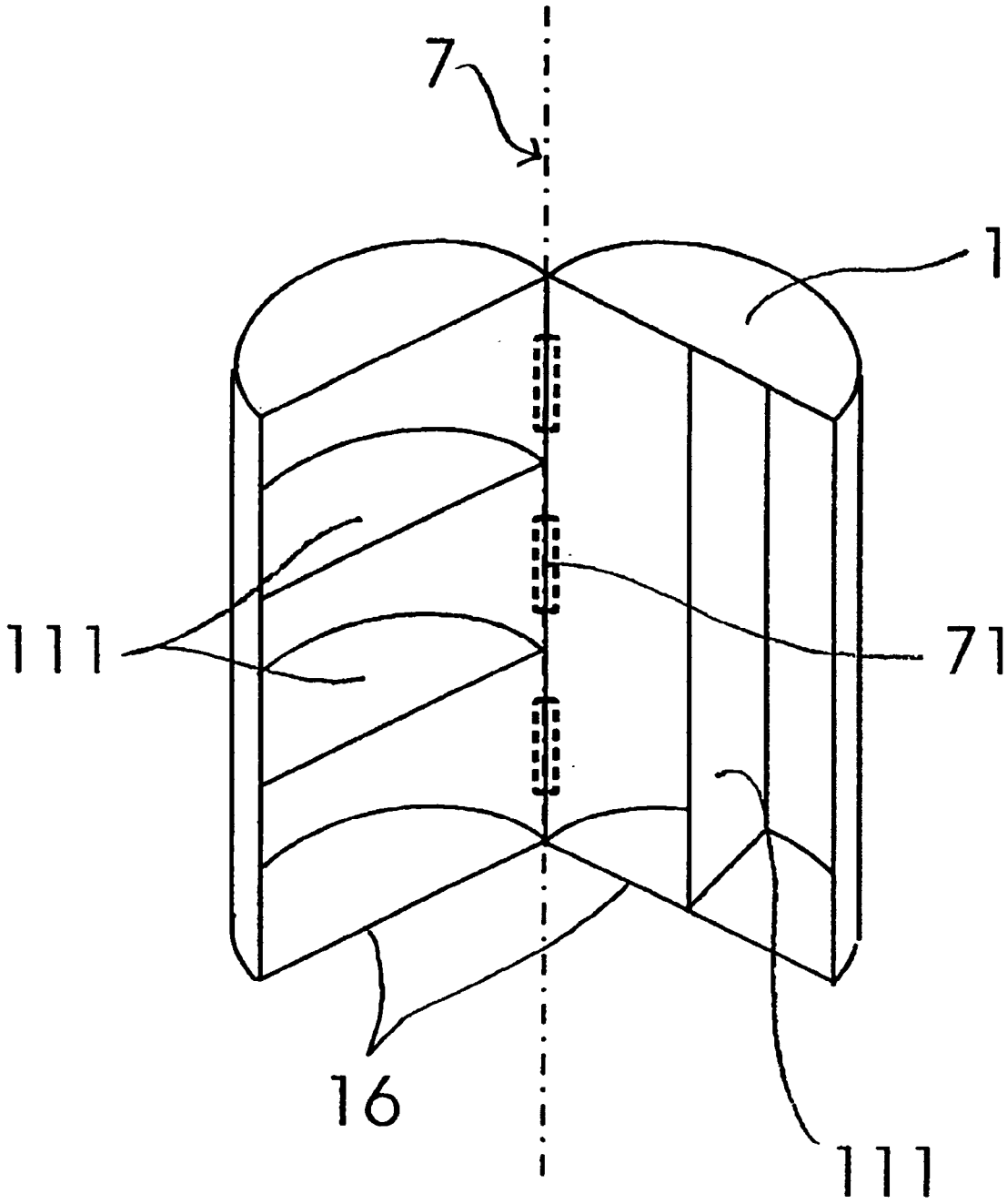
FIG. 7 is a perspective view of the golf bag of FIG. 6 in its open condition.

FIG. 7 is a view of the bag body 1 of a golf bag in accordance with the invention as shown in FIG. 6 wherein the bag is in the open condition. It is obvious that once open the bag allows the user to gain access to the interior of the bag body 1, which is closed on all sides. More specifically, the interior may be divided in compartments or pouches as can be seen from the Fig. One half of the bag body is divided in longitudinal direction, thus creating an elongated storage space within the interior space 11 of the bag in which a jacket for example may be hung. If partition walls of the compartments 111 provided in the two halves of the bag body 1 are facing each other and if they are contiguous when the bag body is closed, the stability of the bag body 1 is advantageously enhanced.

Figure 8:
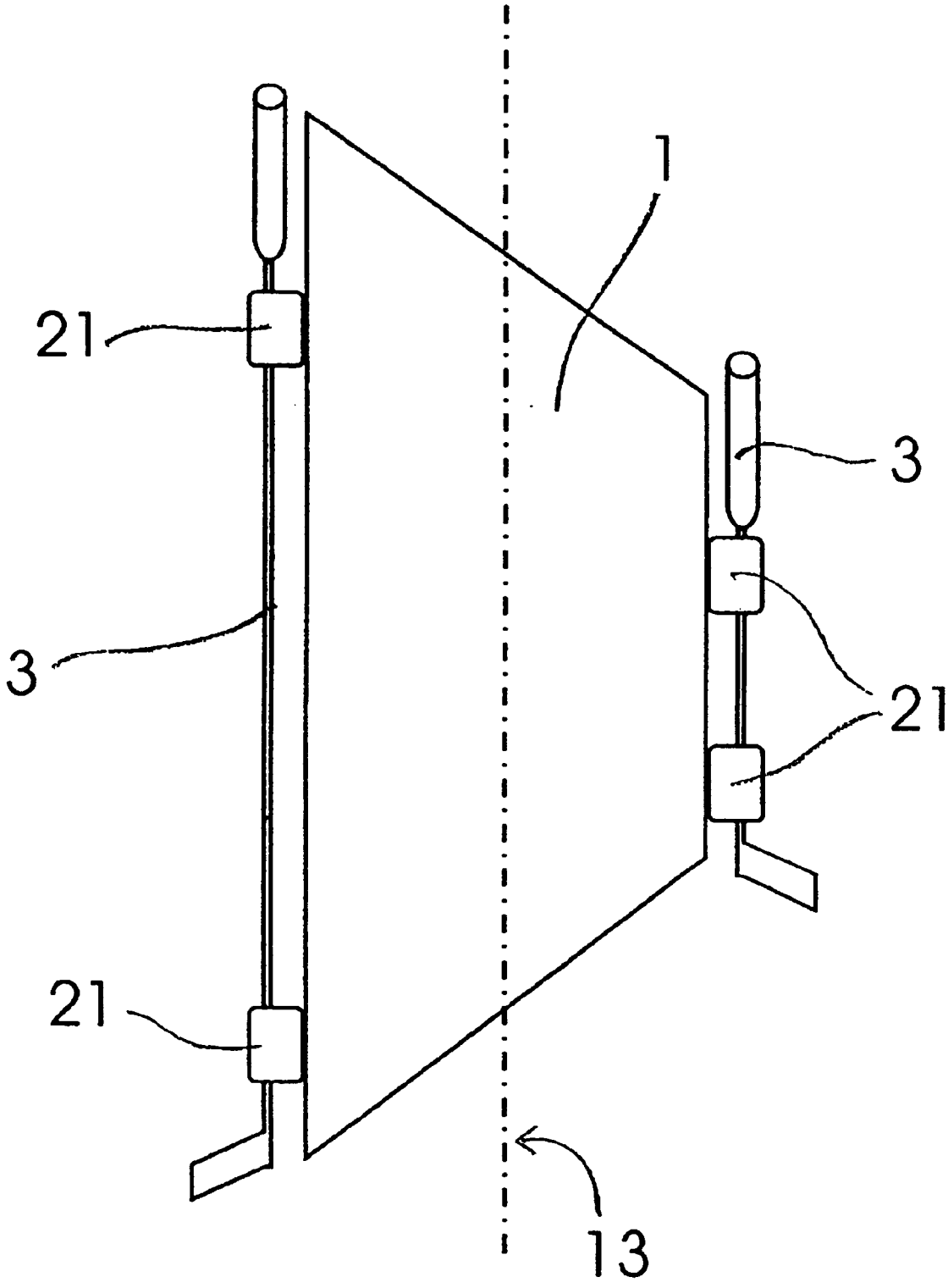
FIG. 8 is a side view of another bag in accordance with the invention with a bag body formed into a special shape.

FIG. 8 is a side view of a golf bag in accordance with the invention, the bag body 1 of which has a round cross-section for example and the upper and lower cover surfaces of which are positioned at an angle different than 90 degrees to the longitudinal axis 13 of the bag body 1. The lateral area 12 thus created has a length which varies continuously between a minimum value and a maximum value in the direction of the longitudinal axis 13. This makes it possible to arrange golf clubs of various lengths on such locations on or in the lateral area 12 that are provided with an appropriate length. This permits to prevent individual clubs 3 from protruding too much, while at the same time the bag may be designed much smaller than with a cylindrical bag body 1. The covers 4 provided according to the invention have been omitted from FIG. 8 for purposes of clarity; however, they may be designed analogous to FIG. 1 for example.

In giving the cross-section of the bag illustrated in FIG. 8 another geometrical shape than the circular one, the circumference of the lateral area 12 may be increased without simultaneously having to increase its diameter.

Particular advantages regarding variability are realized if the bag in accordance with the invention is provided with a frame that provides rigidity and is made for example from a rod-shaped material such as aluminium, steel, glass fiber reinforced plastic or carbon fiber reinforced plastic. A preferably textile cloth is preferably hung and fastened on said frame, said cloth constituting the lateral area 12. Elements are fastened on said textile surface, said elements performing the function of recesses 5, of holding devices arranged therein and of covers 4 for covering said holding devices. Apertures for accessing the holding devices 2, e.g., slots oriented in the direction of the longitudinal axis 13 of the bag body 1, are provided in the textile surface. For transport, the textile surface may be removed from the frame and rolled up together with the elements fastened thereon and the golf clubs 3 retained therein.

In order to adapt the size of the bag to the number of clubs to be carried, the rigidity providing frames may be provided in different sizes. The size of the textile surface may for example be varied in detaching webs of fabric that are reversibly connected to the textile surface by means of a zipper for example.

Figure 9:
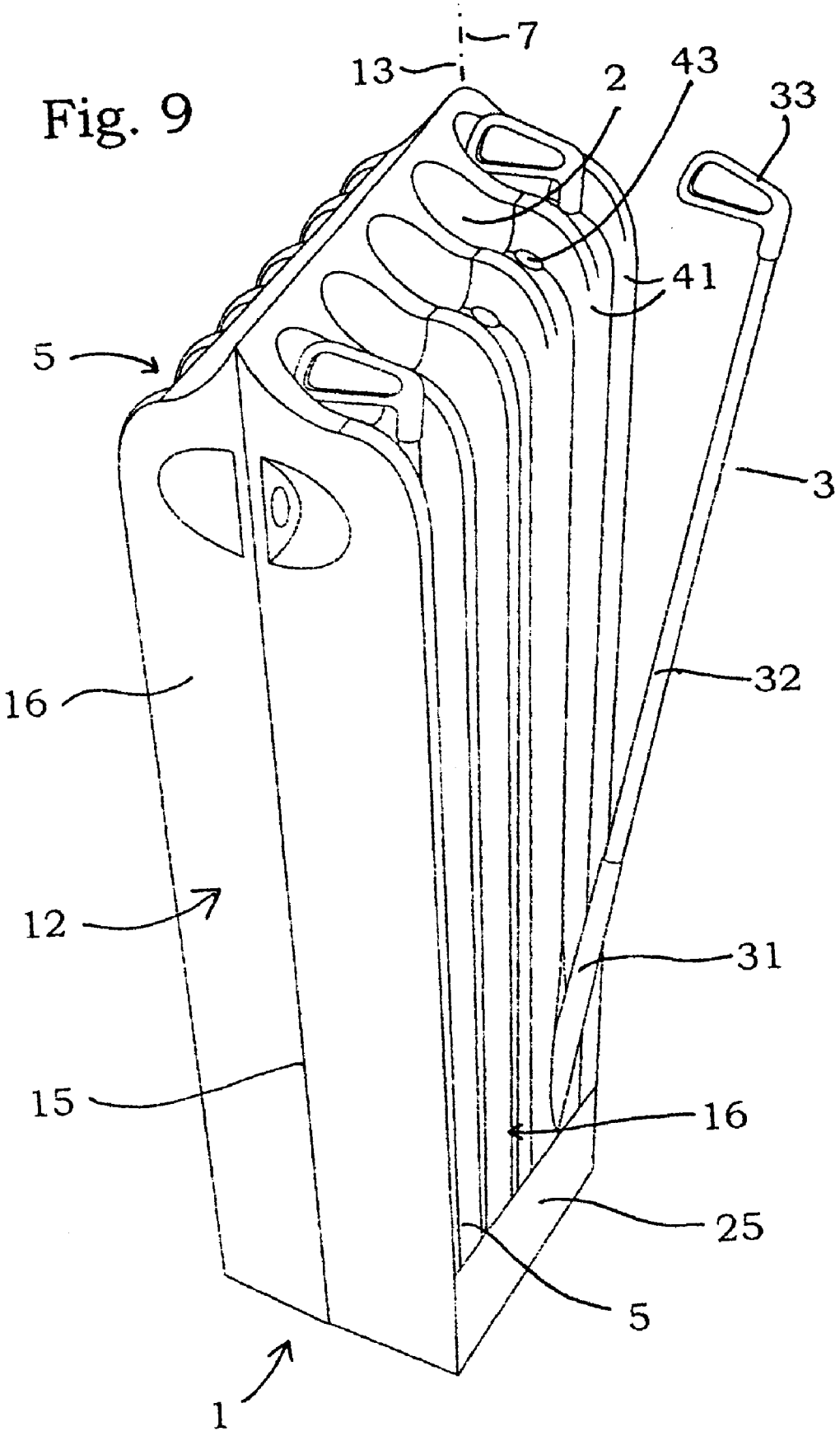
FIG. 9 is a perspective view of another embodiment of the golf bag in accordance with the invention with two retained golf clubs and with one golf club being in the position for removal.
Figure 10:
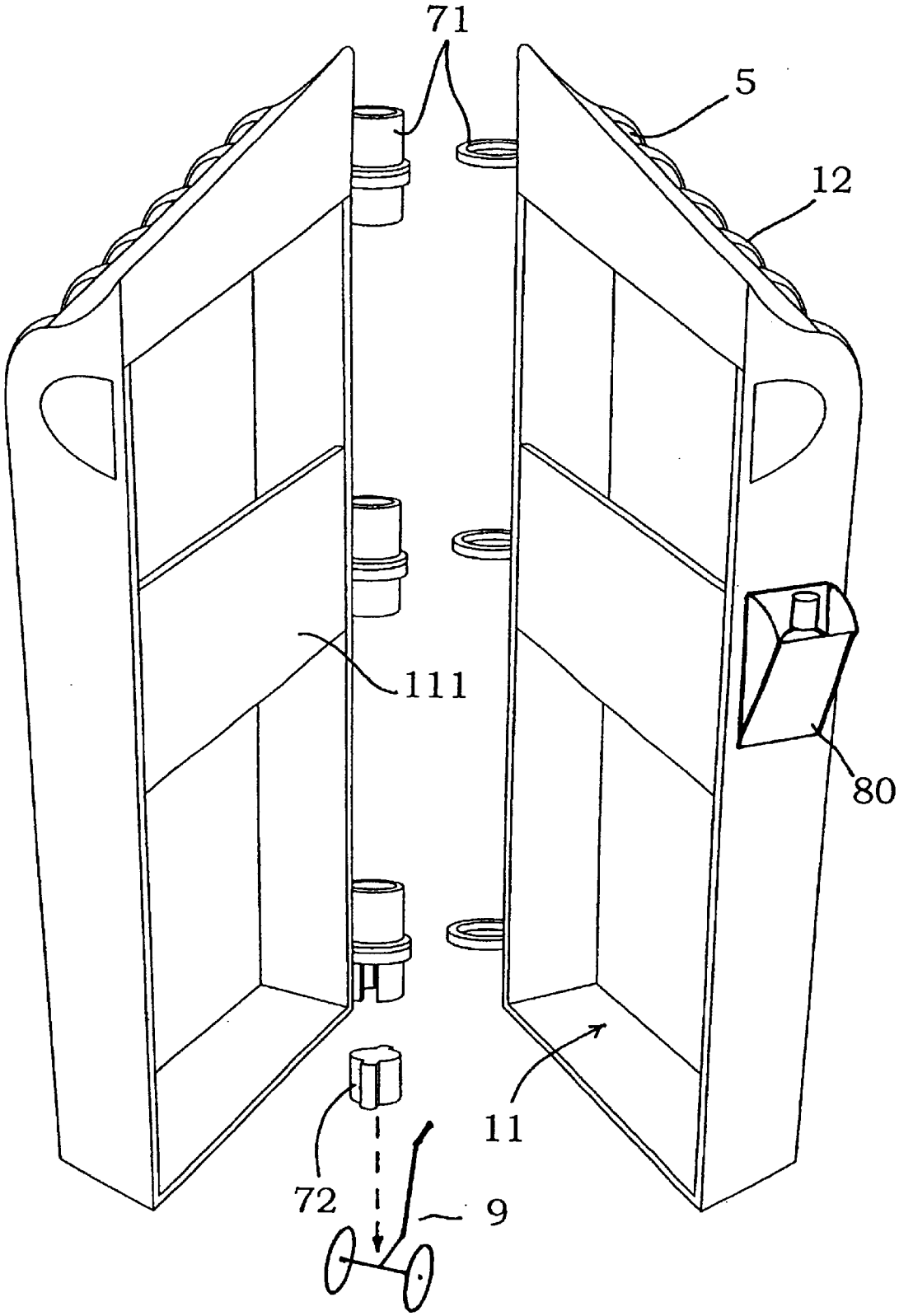
FIG. 10 is a view of the embodiment according to FIG. 9, the two halves of the base body being opened and separated.

The embodiment according to the FIGS. 9 and 10 is provided with two shells 16 or halves that adjoin on a substantially rectangular separating line 15. Each single shell 16 holds 5 golf clubs 3. In this embodiment, the two shells 16 do not differ with regard to the seats for the golf clubs; however, the two shells 16 of one base body may be provided with various possibilities for receiving the golf clubs. Actually, this is even preferred.

The shells 16 are made from a light-weight material. The materials of choice are materials as they are utilized for mouse pads for use with a computer mouse, that is to say thin, hard foils which are reinforced and stiffened by a layer of foamed material. The shells 16 may however also be made from sheet steel such as thin aluminium sheet, injection moulded plastic material, and so on.

The shells 16 have receiving areas or recesses 5 that are accessible from outside the bag. In FIG. 9, only the three rear areas for receiving golf clubs are provided with a self-closing cover 4, the two front areas do not have such a self-closing cover. In the finished embodiment, the front seats may also be provided with self-closing covers. The self-closing covers consist of a flexible foil and are built similar to the exemplary embodiment of FIG. 3, see the halves 41 there.

As can be seen from FIG. 9, the golf clubs 3 are inserted with their grip 31 down. To fit the purpose, the shell 16 is provided with a lower reception space which is closed by a side wall 25. It serves as an abutment when the club 3 is being inserted. It prevents the lower part of the club, which has been inserted first, from slipping out again when the upper part of the club is being pushed into the holding device 2. Side wall 25 is some centimeters high, e.g. 5 cm.

The diverse recesses 5 are oriented substantially parallel to the longitudinal axis 13 or to the hinge axis 7. In the upper region, they project inward toward the separating line 15 so that the head 33 of a club is given enough room. The self-closing covers 4 are thereby designed in such a way that they have a hole 43 for the shaft 32 in the top area where they are overlapping or adjoining. The head 33 projects freely from said hole 43, as can best be seen from FIG. 9. This makes it easy to identify the respective club 3. It is also possible to additionally cover the heads 33 with a cover that covers every single head 33 from the top.

The two shells 16 are joined together by a hinge that can be seen in FIG. 10. It is substantially made from tubes and rings. As a result thereof, its free inside diameter is so large that an umbrella may be inserted along the hinge axis 7 of the assembled hinge and fastened there. The hinge 71 is closed at the bottom to fit the purpose. A securing means is provided so that the hinge is detachably secure against accidental separation of the hinge parts.

As can be surveyed from FIG. 10, the hinge 71 is formed by tube sections that are encompassed by rings that retain them on the left shell 16. The right shell only has rings that are fixed thereon and encompass the tube sections. The lowermost tube section may be put onto a receiving piece 72 which is a component part of a trolley as shown outlined in this FIG. Said receiving piece 72 can be pivoted about an axis oriented parallel to the axis of the trolley's 9 wheels. An angular range may thereby be mechanically predetermined between a position of the container 1 positioned on the receiving piece 72 which is approximately parallel to a handle of the trolley 9 and a vertical position thereof.

It is possible to fasten or clip retainers for additional golf clubs on the tubes of the hinge 71. These retainers are then located behind the rear wall. They may be joined together by a frame.

It proved particularly advantageous to provide the base body, on shell 16 for example, with a tiltable rack 80 for a bottle, as shown outlined in FIG. 10.

Figure 11:
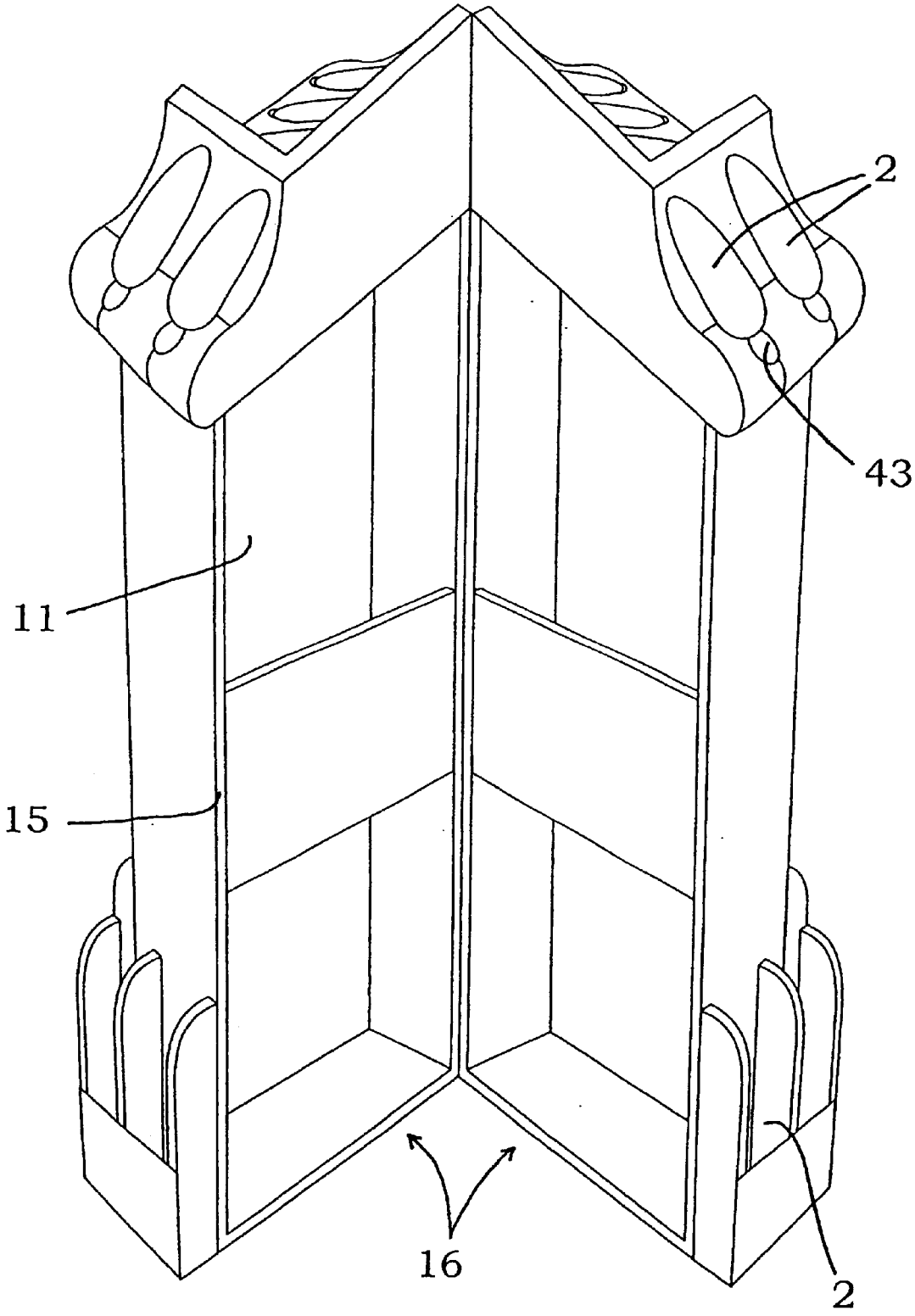
FIG. 11 is a perspective view similar to FIG. 10 of another embodiment.

FIG. 11 illustrates an embodiment wherein the configuration of the two shells 16 differs from that of the embodiment shown in the FIGS. 9 and 10 in that the shells are not provided with five recesses 5 arranged side by side. Each shell 16 rather has two front end recesses 5 provided on the front wall facing the hinge axis 7 and three recesses 5 like the embodiment according to the FIGS. 9 and 10. Like in the exemplary embodiment according to the FIGS. 9 and 10, the one shell 16 may be completely separated from the other. The advantage thereof is that the golfer can take only one shell 16 with the clubs contained therein to the golf course. This may be an advantage in winter for example.

As can be seen from the exemplary embodiments, the two shells 16 of the base body 1 are designed as a substantially symmetrical design. The two shells 16 may even be moulded in the same mould.

In a preferred embodiment, the hinges 71 are only separable when a predetermined relative angular position between the two shells 16 is established.

The material of choice for the lateral area is a 2 mm thick cellular rubber coating deposited on a rigid foil such as polycarbonate, PTF, PTFE or the like.

As can be surveyed from FIG. 10, the length of the recesses 5 increases toward the hinge axis 7. Put another way, the upper edge of the shells 16 is oriented at an oblique angle. As a result thereof, the shell can hold clubs 3 of different lengths.

The self-closing covers 4 are advantageously configured as rows of brushes or rubber lips that are arranged so as to face each other or are made from flat strips of e.g., rubber, foil and so on that are pivotable about a central axis, neighboring strips adjoining or overlapping each other in the closed condition. The holes 43 in the self-closing covers 43 can perform the function of the holding devices.

What is claimed is:

1. A golf bag for a plurality of golf clubs, comprising:

a bag body with a longitudinal axis, an interior space and a lateral area which substantially extends In the direction of the longitudinal axis;

holding devices arranged on or within the lateral area for receiving golf clubs whose club shafts are oriented substantially in the direction of the longitudinal axis, such that golf clubs retained in said holding devices are located outside said interior space, wherein a golf club retained in a holding device is largely covered by a self-closing cover on the side facing away from the interior space, wherein the bag body is made of two shells, and wherein the bag body can be opened along a hinge axis which is oriented substantially parallel to the longitudinal axis thereof, thereby giving access to the interior space.

2. The golf bag of claim 1, wherein the two shells are joined together by a hinge of a hollow configuration.

3. The golf bag of claim 2, wherein the hinge is provided with a coupling piece by means of which the golf bag may be detachably fastened to a trolley.

4. The golf bag of claim 2, wherein the hinge is provided with tubes having an inner width of more than 30 mm.

5. The golf bag of claim 1, wherein the lateral area is provided with recesses that are oriented substantially in the direction of the longitudinal axis and wherein holding devices for holding at least one golf club each are arranged in the recesses.

6. The golf bag of claim 5, wherein a lead-in shoe is provided in the recesses.

7. The golf bag of claim 5, wherein the recesses are individually largely covered by a self-closing cover.

8. The golf bag of claim 7, wherein the self-closing covers leave a region of a golf club retained in a recess uncovered, this region being large enough to permit removal of the golf club from the holding device.

9. The golf bag of claim 8, wherein the uncovered region is arranged in proximity to the respective one of the golf club heads or club grips.

10. The golf bag of claim 8, wherein said sell-closing covers leave a region of the golf club uncovered by means of a recessed grip cavity.

11. The golf bag of claim 8, wherein said self-closing covers leave the golf club uncovered over a length of less than 15 cm.

12. The golf bag of claim 11, wherein said self-closing covers leave the golf club uncovered over a length of less than 10 cm.

13. The golf bag of claim 1, wherein a holding device is provided with at least one of a clip and a fixation for the purpose of positively fixing a club shaft.

14. The golf bag of claim 1, wherein neighboring holding devices are designed in such a manner that a golf club can be secured in a first holding device in an upright position and that the golf clubs in adjacent second holding devices can be fixed with their head down.

15. The golf bag of claim 1, wherein the interior space of the bag body is divided into several compartments.

* * * * *